United States Patent [19]

Bullard

[11] Patent Number: 4,767,145

[45] Date of Patent: Aug. 30, 1988

[54] RUNNING AND PULLING TOOL

[75] Inventor: Roy P. Bullard, Grand Prairie, Tex.

[73] Assignee: Otis Engineering Corporation, Dallas, Tex.

[21] Appl. No.: 916,024

[22] Filed: Oct. 6, 1986

[51] Int. Cl.[4] ..... E21B 23/00

[52] U.S. Cl. ..... 294/86.18; 166/125; 166/217; 294/86.19; 294/86.25

[58] Field of Search ..... 294/86.14, 86.15, 86.17, 294/86.23, 94, 96; 166/125, 137, 215, 217, 98, 99

[56] References Cited

U.S. PATENT DOCUMENTS

| | | | |
|---|---|---|---|
| 1,580,352 | 4/1926 | Ventresca | 294/86.15 |
| 3,051,239 | 8/1962 | Dollison | 166/125 |
| 3,863,715 | 2/1975 | Yonker | 166/125 X |
| 4,295,528 | 10/1981 | Carmody | 166/217 X |
| 4,368,911 | 1/1983 | Pringle | 294/86.25 X |
| 4,558,895 | 12/1985 | Tamplen | 294/86.18 |

OTHER PUBLICATIONS

Otis Wireline Equipment Brochure, OEC 5121 C, p. 115, "Otis Wireline Pulling Tools".

*Primary Examiner*—Johnny D. Cherry
*Attorney, Agent, or Firm*—Roland O. Cox

[57] ABSTRACT

An improved running pulling tool utilizing dogs for engaging an internal fishing neck on a well tool. The dogs are locked in fishing neck engaging position on the tool mandrel and are unlocked by jarring downwardly, upwardly and again downwardly and moved to a position on the mandrel retracting the dogs and releasing the improved tool from the fishing neck. The improved structure provides a tool which may be jarred upwardly on or jarred downwardly on as long as required and which may be released from the well tool fishing neck when desired. When the tool is jarred downwardly on, it will operate to release if either the tool skirt or mandrel contact the well tool. The skirt may be positioned to contact shoulders on the dogs and eliminate costly precision machining and provide more area to absorb jarring impact on the tool. On surface the improved tool can be manually released from a fishing neck and manually prepared for further use.

14 Claims, 5 Drawing Sheets

RUNNING AND PULLING TOOL

BACKGROUND

This invention pertains to tools useful in servicing earth wells and particularly running and pulling tools usually used in wireline tool strings to run, operate in and pull tools from a well.

Many forms of running tools, pulling tools, and combination running and pulling tools have been developed to engage external and internal fishing necks on well tools to be run into or pulled from wells on pipe or wireline. Weight or pull is applied to running and pulling tools or they are "jarred", either upwardly or downwardly, to engage tool fishing necks on tools installed in wells, to lock, unlock or operate well tools while engaged and to release from a fishing neck after locking the tool or if the tool cannot be jarred to unlock and be retrieved from the well.

One form of a pulling tool is shown in U.S. Pat. No. 3,051,239 to Dollison. This tool engages an internal fishing neck and can only be released from the fishing neck by jarring downwardly and cannot be released if the tool mandrel or attached prong contacts inside an engaged fishing neck before the tool skirt contacts the top end of a fishing neck. Also this tool was found to be expensive to manufacture because of close parts tolerances required to strengthen the tool to resist repeated jar impacting and is difficult to release from tool fishing necks manually on the surface.

As well servicing art and tools developed, requirements arose for this type running pulling tool to be jarred upwardly to cause release from a well tool fishing neck. As shown on page 115 of OTIS WIRELINE SUBSURFACE FLOW CONTROLS AND RELATED SERVICE EQUIPMENT, OEC 5121C, a publication of Otis Engineering Corporation, Dallas, Tex., a "GU" shear up adapter was made available to convert the modified "GS" running and pulling tool covered by the Dollison patent into a jar upwardly to release tool. This tool must be assembled with the adapter on the surface as a jar upwardly to release tool or without adapter for a jar downwardly to release tool, before running into the well.

An example of a pulling tool which engages an external fishing neck is covered by U.S. Pat. No. 4,558,895 to Tamplen. This tool must also be assembled on the surface for either upward jar release or downward jar release.

The improved running pulling tool of this invention provides a tool which may be repeatedly jarred downwardly to upwardly as required after engaging an internal fishing neck and later be released from the fishing neck at any desired time by downward jarring. This tool will release when jarred downwardly on contact of either the lower end of the mandrel with the inside of the engaged fishing neck or by contact of the lower end of the skirt with the top of the finishing neck. The lower housing skirt may be positioned to eliminate clearances between assembled parts, which gives the tool extended impact life, permits looser part tolerances and reduces manufacturing costs. After the invention tool has pulled a well tool to the surface, the improved pulling tool may be easily released from the well tool fishing neck with a common hand tool.

One object of this invention is to provide one tool which may be used to run or pull well tools from a well.

Another object of this invention is to provide a running pulling tool which, after engaging a well tool fishing neck, may be either jarred upwardly or jarred downwardly as long as required.

Another object of this invention is to provide a running pulling tool which may be released from a fishing neck at any time after engagement therewith.

Another object of this invention is to provide a running pulling tool which does not have to be retrieved to surface to reverse jarring direction for release.

Another object of this invention is to provide a running pulling tool which, when jarred down, will operate if the tool contacts the well tool fishing neck or if the tool mandrel contacts the well tool.

Also an object of this invention is to provide a less expensive running pulling tool not requiring precisely manufactured parts.

Another object of this invention is to provide a running pulling tool having improved impact resistance when jarred upwardly.

DESCRIPTION OF THE PREFERRED EMBODIMENT

Figure 1A:
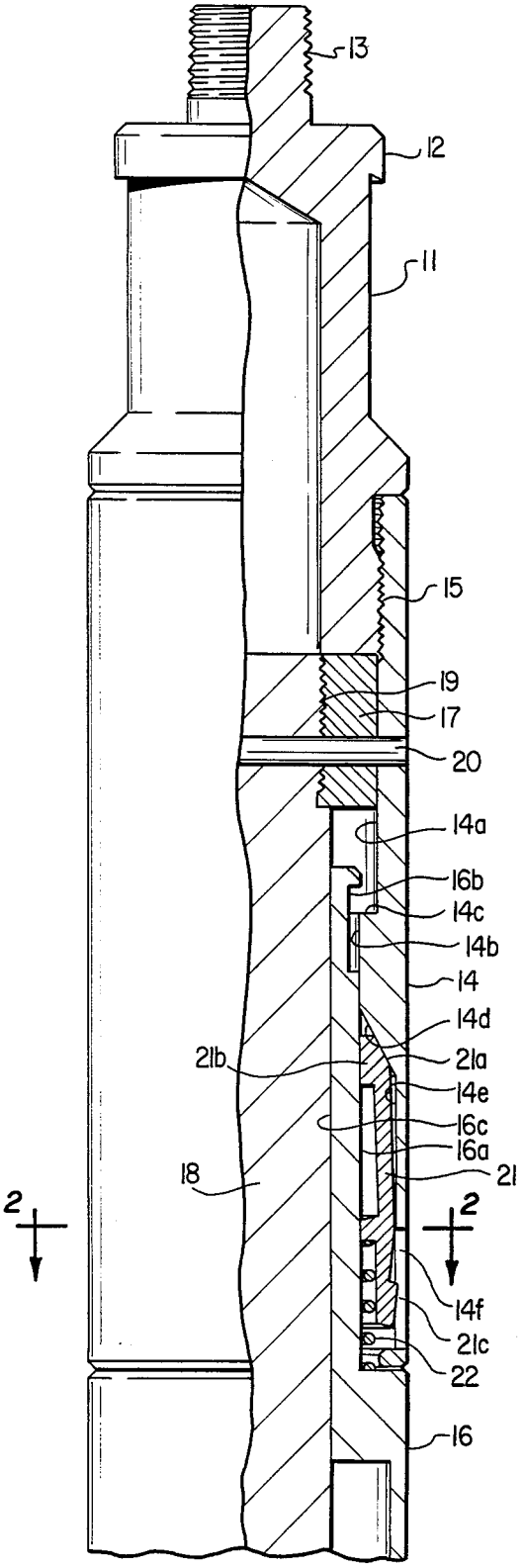
FIGS. 1A and 1B are a sectioned drawing in elevation of the running pulling tool of this invention, shown engaging a fishing neck.
Figure 1B:
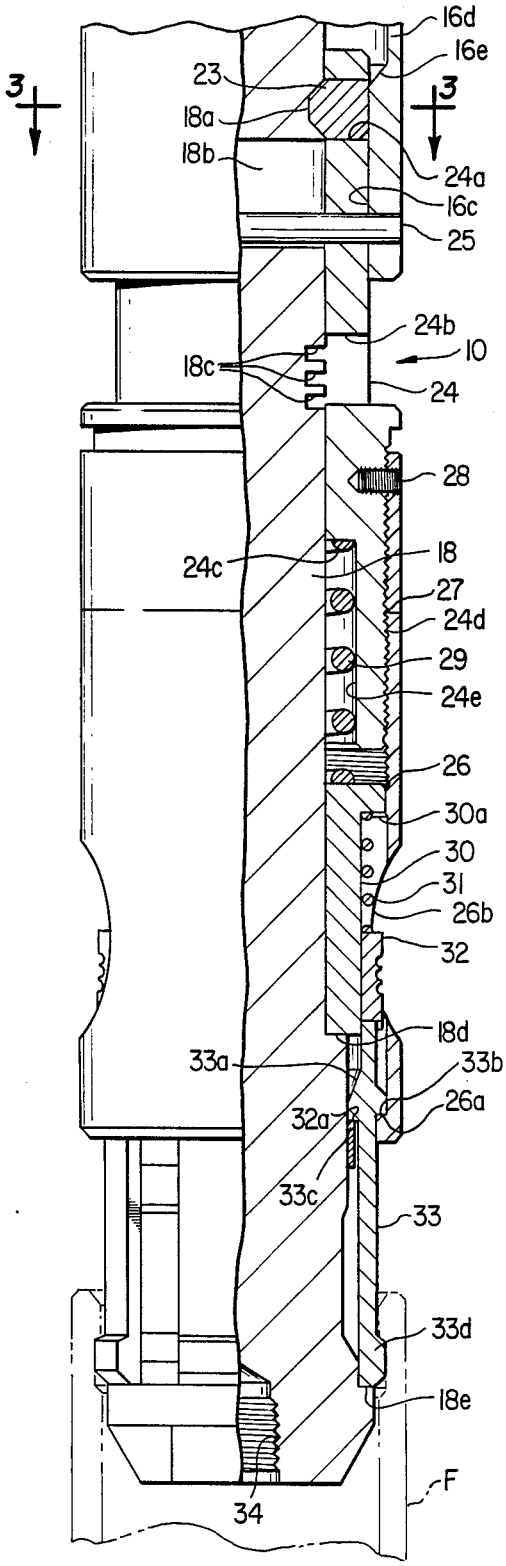

FIGS. 1A and 1B show the running pulling tool 10 of this invention, which has a fishing neck 11 with an external flange 12 and an appropriate thread 13 for connecting the tool to a wireline tool string or pipe. The fishing neck is connected to upper connecting housing 14 with threads 15. The upper housing has bores **14*a* and 14*b*, a shoulder 14*c*, a camming surface 14*d*, and another bore 14*e* with openings 14*f* therein. Slidably mounted in housing bore 14*b* is a reduced diameter portion 16*a* of intermediate locking housing 16. This housing has a groove 16*b*, a bore 16*c*, an overbore 16*d* and a camming surface 16*e***.

Slidably mounted in upper housing bore **14*a* is a nut 17 connected to tool mandrel 18 by thread 19. A shear pin 20 passes through the upper housing wall, the nut, the mandrel and on through the nut and other housing wall and retains nut 17 on mandrel 18**.

Figure 2:
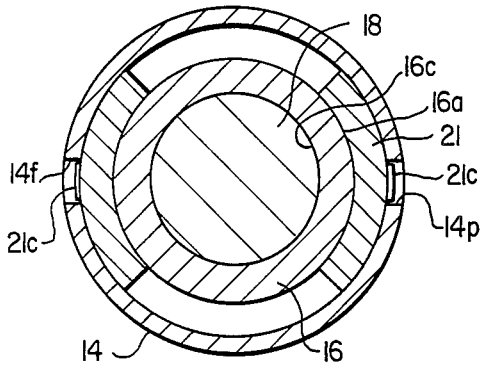
FIG. 2 is the drawing of a cross section along line 2—2 in FIG. 1.
Figure 7:
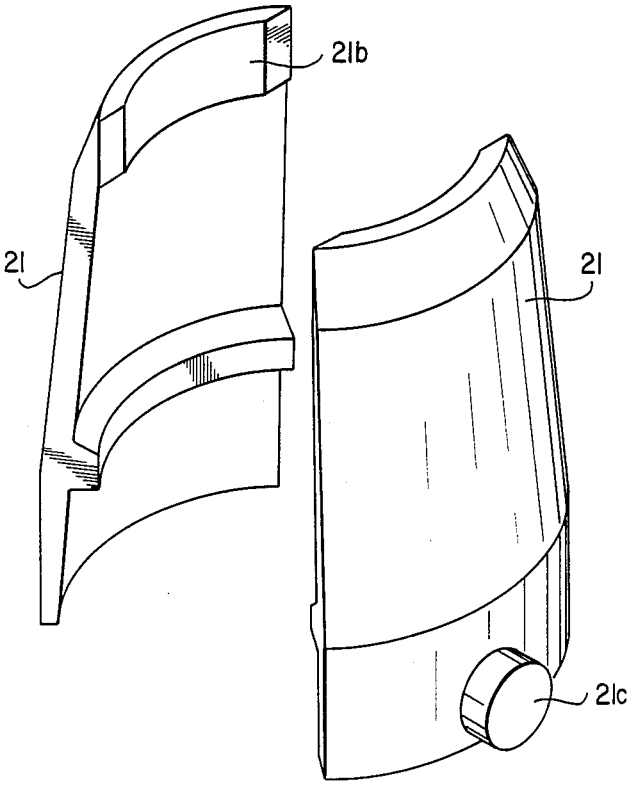
FIG. 7 is an isometric view of latches utilized in the present invention.

Mounted in bore **14*e* in housing 14 around portion 16*a* are latches 21, also shown in FIGS. 2 and 7. Each latch has a camming surface 21*a* engaging surface 14*d* and end projections 21*b* and 21*c*. A compressed spring 22 maintains engagement of surfaces 21*a* and 14*d***.

Figure 3:
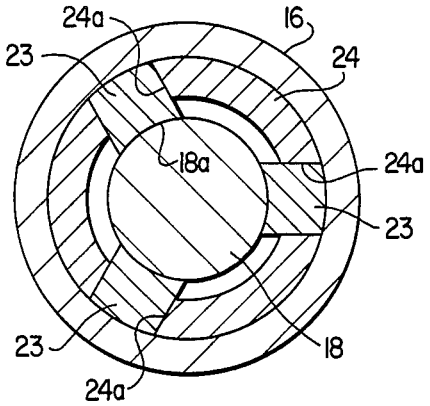
FIG. 3 is the drawing of a cross section along line 3—3 in FIG. 1.

FIG. 1 and FIG. 3 show cammable lugs 23 mounted for lateral movement in openings **24*a* in lower engaging and releasing housing 24 and held engaged in mandrel recess 18*a* by bore 16*c* in the upper housing. Intermediate housing 16 is connected to lower housing 24 by shear pin 25. This shear pin may move longitudinally in lateral opening 18***b* in mandrel 18. The lower housing is slidably mounted on the mandrel and has an opening 24*b*, a shoulder 24*c*, a thread 24*d* and a bore 24*e*. Mandrel 18 has a number of grooves 18*c* adjacent opening 24*b*. Threadedly connected to the housing by thread 24*d* is a skirt 26 and a jam ring 27. The skirt has an internal shoulder 26*a* and openings 26*b*. A lock screw 28 is threaded through the jam ring into the lower housing to lock the jam ring in position. Disposed in bore 24*e* and around the mandrel is a compressed spring 29 between shoulder 24*c* and the top of a spacer ring 30. The spacer has a shoulder 30*a* and is biased into contact with upper mandrel shoulder 18*d* by spring 29. Around spacer 30 is a compressed spring 31 between shoulder 30*a* and retainer ring 32 which biases the retainer and dogs 33 downwardly to engage lower mandrel shoulder 18*e*. Each dog 33 has a camming surface 33*a*, an external shoulder 33*b*, an internal shoulder 33*c* and a lug portion 33*d*. Shoulders 33*c* protrude into openings 32*a* in the retainer. A thread 34 is provided at the lower end of mandrel 18 for attachment of appropriate operating prongs to tool 10. Dogs 33 are shown engaging an internal fishing neck F in FIG. 1B.

After assembly of running pulling tool 10 and before screw 28 is installed, ring 27 is turned to permit skirt 26 to be turned and adjusted so that shoulder 26*a* contacts dog shoulders 33*b*. This contact area, in addition to the area of contact between the lower end of dogs 33 and shoulder 18*e*, is available to share impact force loading on the tool when jarring up. Heretofore the additional area was not available on running pulling tools, even with expensive very close tolerance machining of many tool parts because of cumulative tolerance buildup between a number of parts in an assembly.

After proper adjustment of skirt 26, jam ring 27 should be tightened against the skirt to retain the skirt in proper position, and lock screw 28 should be installed through the ring to lock the ring in skirt jamming position.

The tool 10 of the present invention is used as a running tool by attaching to a tool string and engaging in an internal well tool fishing neck on the surface. Tool 10 carrying a well tool is then lowered into a well conduit and jarred or weight or pull applied to operate the well tool. The running pulling tool is then jarred downwardly or weight is applied to operate and release it from the well tool fishing neck for retrieval to the surface as described below.

Figure 4A:
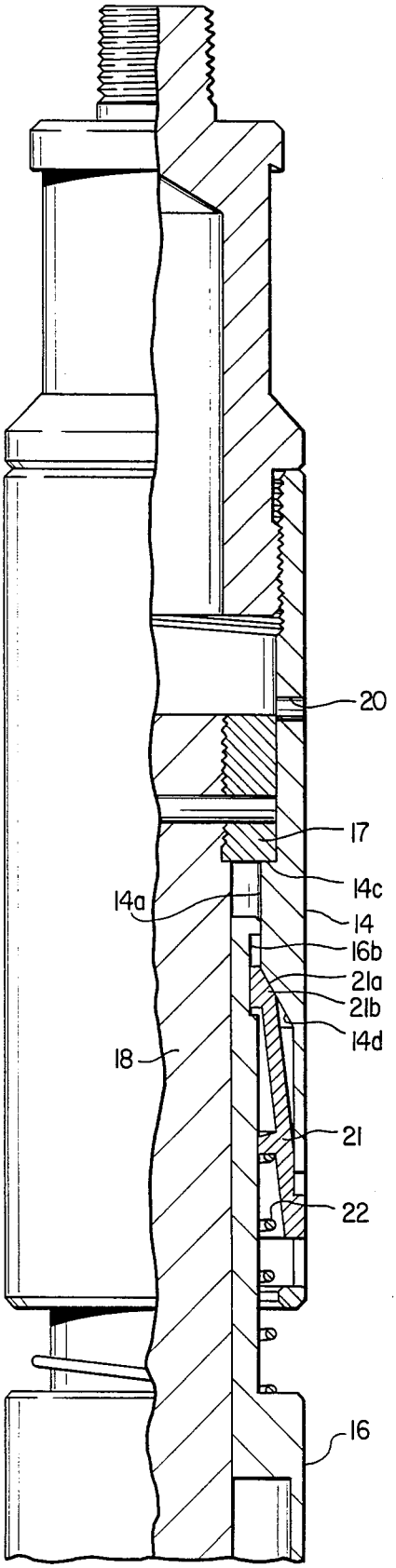
FIGS. 4A and 4B are a sectioned drawing in elevation of the invention tool shown in the first stage of releasing from the fishing neck.
Figure 4B:
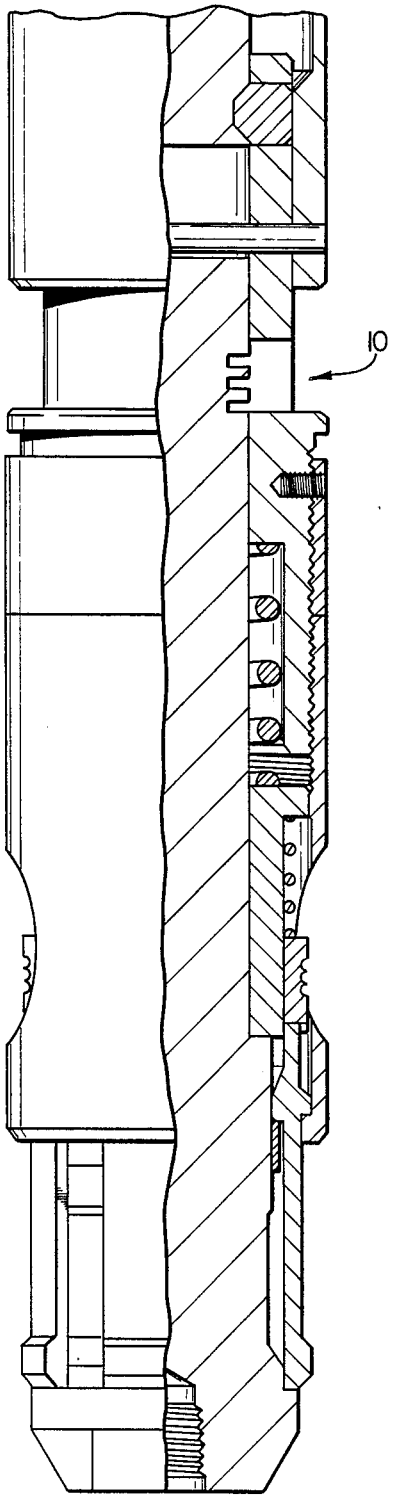

To use the tool 10 of the present invention as a pulling tool, the tool in the form of FIGS. 1A and 1B is connected in a tool string and lowered into well pipe to latch into and engage the internal fishing neck on top of a well tool set in the well. The running pulling tool 10 is then jarred downwardly to release the well tool for pulling from the well. While jarring down, either tool mandrel 18 or the lower end of skirt 26 may impact the well tool or well tool fishing neck. Impact of the invention tool on the well tool is not limited to skirt bottom to fishing neck top only, and the tool may be operated to release if impact is delivered to the well tool fishing neck through the skirt or mandrel of invention tool 10. If the well tool cannot be released by prolonged jarring downwardly, the tool 10 may be jarred upwardly, which shears pin 20, permitting shoulder 14*c* in the upper housing to be moved up to contact the lower end of nut 17. As shown in FIG. 4, spring 22 has moved latches 21 upwardly, and camming surfaces 21*a* moving along camming surfaces 14*d* has moved the latch end projections 21*b* into groove 16*b*, connecting upper housing 14 to intermediate housing 16.

If prolonged upward jarring does not release the well tool, then running pulling tool 10 may again be jarred downwardly to release from the well tool fishing neck.

Figure 5A:
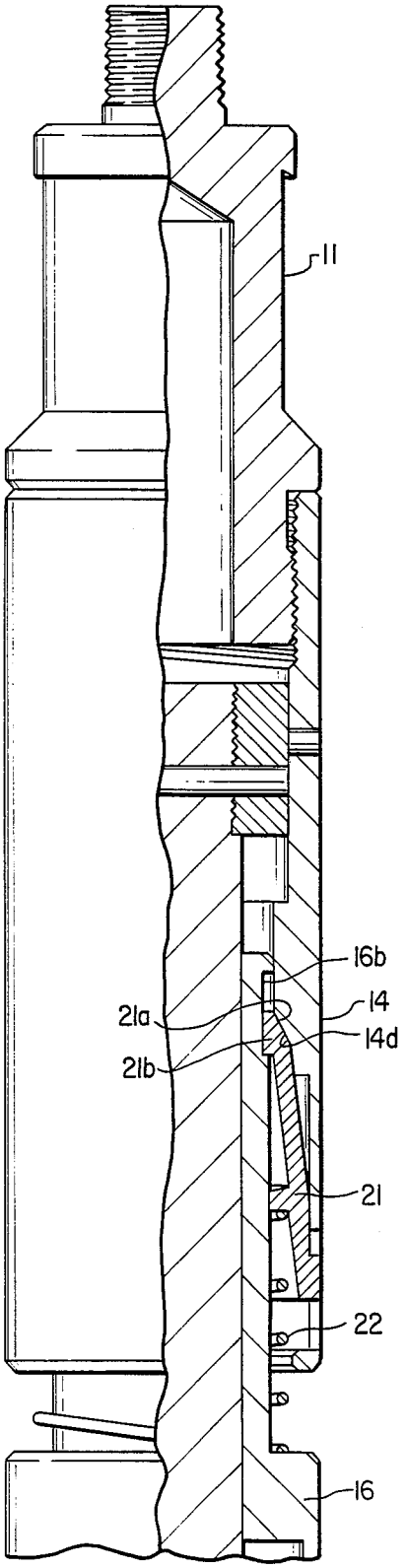
FIGS. 5A and 5B show the invention tool in the second stage of releasing.
Figure 5B:
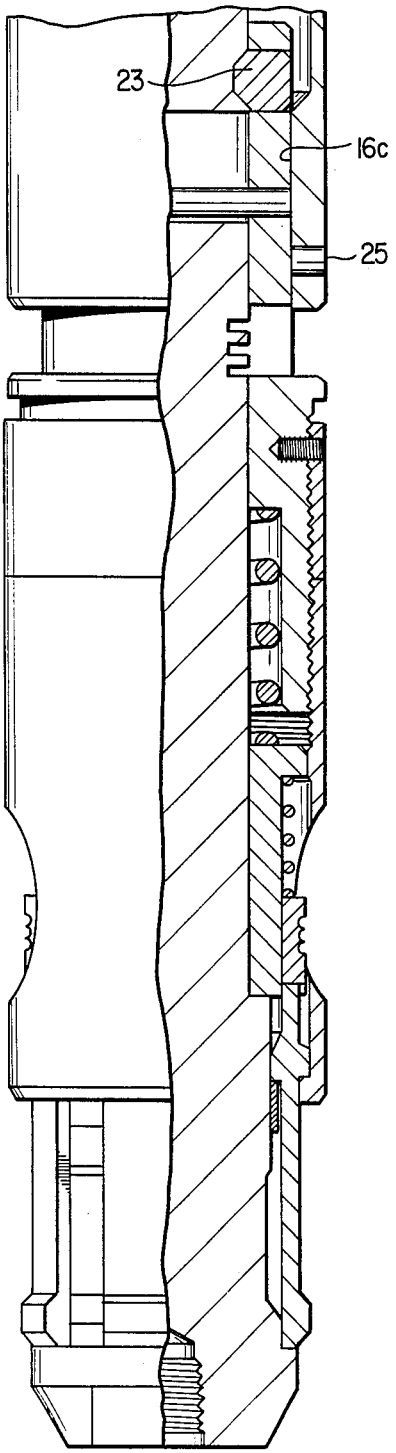

As the upper and intermediate housings are now connected by latches 21, downward jarring will move fishing neck 11, upper body 14 and intermediate body 16 downwardly, shearing pin 25 and moving bore 16*c* below lug 23 as shown in FIG. 5. Now, a shown in FIG. 6, compressed spring 29 moves lower housing 24 upward on the mandrel, camming lugs 23 out of mandrel groove 18*a* and into housing overbore 16*d*, disconnecting housing 24 from mandrel 18. Spring 29 moves lower housing 24 further upward, lifting skirt 26 and dogs 33 through shoulders 26*a* and 33*b* from shoulder 18*e*. Just before upward travel of the lower housing and dogs is stopped by contact with the lower end of intermediate housing 16, dog camming surface 33*a* contacts the outside lower end corner of spacer 30, and dogs 33 are cammed inwardly to contact a smaller diameter on mandrel 18, disengaging fishing neck F and releasing tool 10 from the well tool fishing neck for retrieval from the well.

Figure 6A:
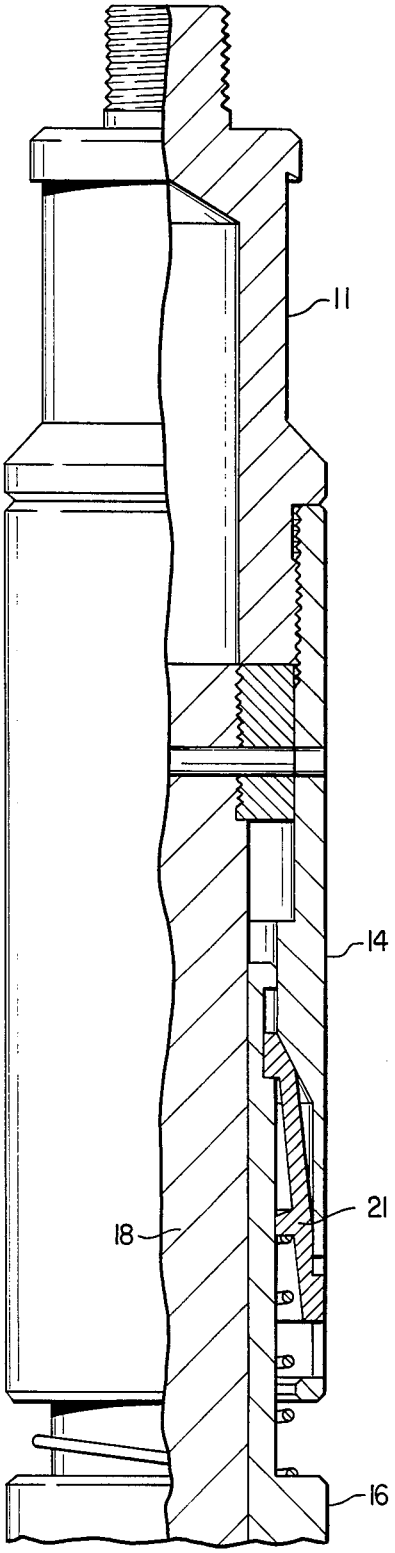
FIGS. 6A and 6B show the invention tool released from the fishing neck.
Figure 6B:
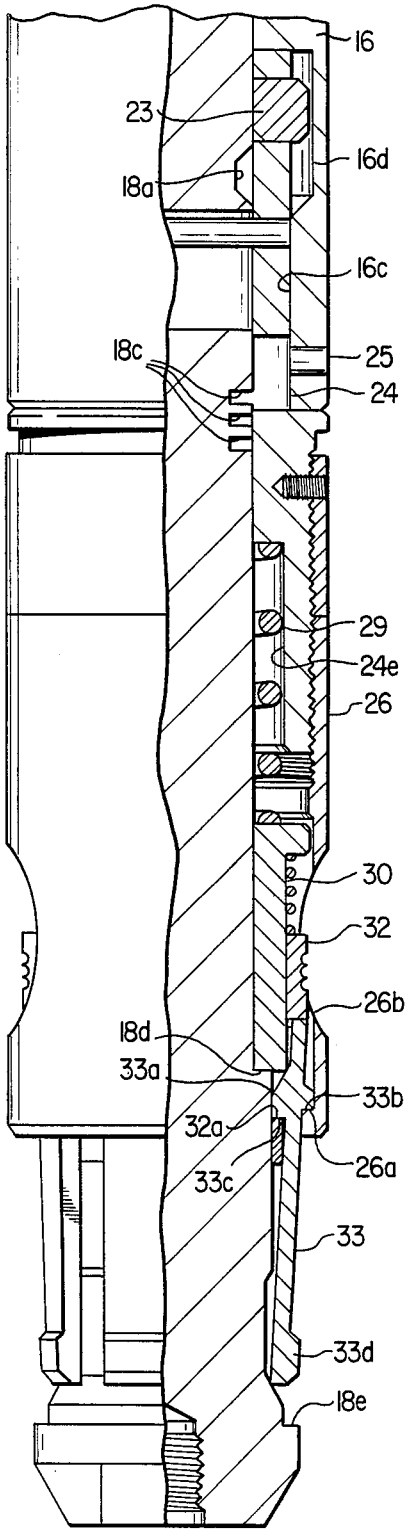

At the surface, retainer 32 may be gripped through skirt openings 26*b* and moved upwardly on spacer 30, compressing spring 31, lifting dogs 33 from shoulder 18*e* and camming the dogs to retract inwardly as shown in FIG. 6, releasing tool 10 from the well tool fishing neck. Upper housing 14 may be moved upwardly on housing 16 and latch projections 21*c* pushed in to disconnect the upper housing from the intermediate housing. A screwdriver or other lever, inserted through opening 24*b* and into a slot 18*c*, may be used to pry the lower housing and dogs back into fishing neck engaging position as shown in FIG. 1. On replacement of sheared pins 20 and 25, the running pulling tool of this invention will be ready for further use.

My invention is defined by the following claims:

1. A tool for releasably engaging an internal fishing neck comprising:

(a) an elongate mandrel;

(b) means slidably mounted on said mandrel for engaging and releasing the fishing neck, said means including:

upper and lower shoulders on said mandrel, a housing having upper and lower external shoulders and an internal shoulder, said housing slidably mounted and releasably positioned on said mandrel above said upper mandrel shoulder, a skirt having an internal shoulder threadedly connected on said housing, and a spacer ring having an external shoulder slidably mounted around said mandrel above said upper mandrel shoulder in said skirt, biasing means in said housing, biasing said housing upwardly, a retainer ring slidably mounted around said spacer ring below said spacer ring external shoulder, at least two dogs slidably mounted in said skirt and extending therefrom, each said dog having upper external and internal shoulders and a lower lug engageable in the internal fishing neck, and outer biasing means in said skirt biasing said dogs downwardly into contact with said mandrel lower shoulder and fishing neck engaging position;

(c) unlockable locking means for locking said engaging and releasing means in fishing neck engaging position on said mandrel; and (d) slidable connecting means for connecting to said locking means to unlock and move said engaging and releasing means to a position on said mandrel releasing the tool from said fishing neck.

2. The tool of claim 1 wherein the biasing means is a coil spring around the mandrel between the spacer ring and the internal housing shoulder.

3. The tool of claim 1 wherein the outer biasing means is a coil spring around the spacer ring between the external spacer ring shoulder and retainer ring.

4. The tool of claim 1 wherein the unlockable locking means include:

(a) a recess on the mandrel;

(b) openings in the upper wall of the engaging and releasing means housing;

(c) a laterally moveable lug in each said opening; and (d) a locking housing having an internal recess, slidably mounted around the mandrel and releasably connected to the engaging and releasing means housing.

5. The tool of claim 4 wherein the connecting means comprise:

(a) a recess around the locking housing;

(b) a connecting housing slidably mounted on the mandrel and said locking housing, said connecting housing releasably connected to the mandrel and having an upper end connection, an external fishing neck therebelow, a through bore and an overbore therein, and a tapered camming surface between said bore and said overbore;

(c) latches, slidably mounted on said locking housing in said connecting housing overbore, each latch having an upper lug engageable in said recess around the locking housing and a lower tapered camming surface thereon; and (d) means biasing each latch for engaging said latch camming surface with said connecting housing camming surface.

6. The tool of claim 5 wherein the means biasing each latch comprises:

(a) an external shoulder on the locking housing;

(b) an internal shoulder in each latch; and (c) a spring around said locking housing between said shoulders.

7. The tool of claim 1 wherein the engaging and releasing means further include releasable positioning means for moving the skirt internal shoulder into contact with the upper external dog shoulders and means locking said skirt in contacting position.

8. The tool of claim 7 wherein the skirt positioning and locking means comprise:

(a) a jam ring threadedly connected around the housing between the lower external shoulder and the skirt; and (b) a lock screw threaded through said jam ring and into said housing;

9. The tool of claim 1 further including means for moving the engaging and releasing means from fishing neck release position to fishing neck engaging position.

10. The tool of claim 9 wherein the moving means include a lateral opening in the housing and grooves around the mandrel adjacent said opening.

11. The tool of claim 1 wherein the engaging and releasing means further include means for manually moving the dogs to fishing neck release position.

12. The tool of claim 11 wherein the manual moving means comprise:

(a) openings in the skirt;

(b) gripping surfaces on the retainer ring, grippable through said openings;

(c) a spring around the spacer ring between the spacer ring shoulder and the retainer ring; and (d) a lateral opening in said retainer ring for each dog and an internal dog shoulder positioned in each said opening.

13. A tool for releasably engaging an internal fishing neck comprising:

(a) an elongate mandrel;

(b) means slidably mounted on said mandrel for engaging and releasing the fishing neck including, (i) a housing having an internal shoulder releasably positioned on said mandrel, (ii) a skirt having an internal shoulder threadedly connected on said housing, and (iii) at least two dogs slidably mounted in said skirt and extending therefrom, each said dog having an upper external shoulder and a lower lug engageable in an internal fishing neck, (iv) releasable positioning means on said housing for moving said skirt internal shoulder into contact with said upper dog shoulders, and (v) means locking said skirt in contacting position, and (vi) means for manually moving said dogs to fishing neck release position;

(c) unlockable locking means for locking said engaging and releasing means in fishing neck engaging position on said mandrel;

(d) slidable connecting means for connecting to said locking means to unlock and move said engaging and releasing means to a position on said mandrel releasing said tool from said fishing neck; and (e) means for moving said engaging and releasing means from fishing neck release position to fishing neck engaging position.

14. A tool for releasably engaging an internal fishing neck comprising:

(a) an elongate mandrel having upper and lower shoulders;

(b) a housing having an internal shoulder, said housing slidably mounted and releasably positioned on said mandrel above said upper mandrel shoulder;

(c) a skirt having an internal shoulder, threadedly connected on said housing;

(d) a spacer ring having an external shoulder slidably mounted around said mandrel above said upper mandrel shoulder in said skirt;

(e) biasing means in said housing, biasing said housing upwardly;

(f) a retainer ring slidably mounted around said spacer ring below said spacer ring external shoulder;

(g) at least two dogs slidably mounted in said skirt and extending therefrom, each said dog having an upper external shoulder and a lower lug engageable in the internal fishing neck;

(h) outer biasing means in said skirt biasing said dogs downwardly into contact with said lower mandrel shoulder and fishing neck engaging position;

(i) a recess on the mandrel above said upper shoulder;

(j) openings in said housing;

(k) a laterally moveable lug in each said opening engageable in said mandrel recess;

(l) a locking housing having an internal recess slidably mounted around the mandrel and releasably connected to said housing;

(m) a recess around said locking housing;

(n) a connecting housing slidably mounted on the mandrel and locking housing and releasably connected to the mandrel, said connecting housing having an upper end connection, an external fishing neck therebelow and a through bore, an overbore in said bore, a downwardly and outwardly tapering camming surface connecting said bore and said overbore;

(o) latches slidably mounted on the locking housing in said connecting housing overbore, each latch having an upper lug engageable in said locking housing recess and a tapered camming surface biased to contact said connecting housing camming surface; and (p) lateral openings in said connecting housing, each said latch including a lower lug protrudable into one of said lateral openings.

* * * * *